US007159868B2

(12) United States Patent
Webb

(10) Patent No.: US 7,159,868 B2
(45) **Date of Patent: *Jan. 9, 2007**

(54) DEALER AND PLAYER HAND COMBINATION SIDE WAGER

(75) Inventor: Derek J. Webb, Littleover (GB)

(73) Assignee: Prime Table Games LLC, Las Vegas, NV (US)

( * ) Notice: Subject to any disclaimer, the term of this patent is extended or adjusted under 35 U.S.C. 154(b) by 279 days.

This patent is subject to a terminal disclaimer.

(21) Appl. No.: 10/891,185

(22) Filed: Jul. 15, 2004

(65) Prior Publication Data

US 2004/0248636 A1 Dec. 9, 2004

Related U.S. Application Data

(63) Continuation-in-part of application No. 10/262,901, filed on Oct. 3, 2002, now Pat. No. 6,789,800.

(51) Int. Cl.
*A63F 3/08* (2006.01)
*A63F 1/00* (2006.01)

(52) U.S. Cl. ..... 273/274; 273/292

(58) Field of Classification Search ..... 273/274, 273/292

See application file for complete search history.

(56) References Cited

U.S. PATENT DOCUMENTS 4,861,041 A 8/1989 Jones et al.
5,208,132 A * 5/1993 Kamada et al. ..... 430/138
5,288,081 A 2/1994 Breeding
5,377,993 A 1/1995 Josephs
5,685,774 A 11/1997 Webb
6,012,719 A 1/2000 Webb
6,022,022 A * 2/2000 Smith ..... 273/292
6,227,969 B1 5/2001 Yoseloff
6,461,240 B1 * 10/2002 Perkins ..... 463/13
6,631,906 B1 * 10/2003 Timpano ..... 273/292
6,789,800 B1 * 9/2004 Webb ..... 273/292

OTHER PUBLICATIONS

Morehead, Albert H. et al., "The New Complete Hoyle Revised", Doubleday, Jan. 1991, pp. 5, 6, 28 and 29.

* cited by examiner

*Primary Examiner*—Eugene Kim
*Assistant Examiner*—Alyssa M. Lowen
(74) *Attorney, Agent, or Firm*—Nixon & Vanderhye P.C.

(57) ABSTRACT

A method of playing a side game is provided in combination with a game of chance such as Pai Gow Poker where a dealer hand of playing cards is dealt to a dealer and a player hand of playing cards is dealt to a player. The method includes receiving a side game wager from the player, wherein after dealing the dealer hand and the player hand, all playing cards from the dealer hand and player hand are combined into a combined hand. The side game wager is resolved according to the playing cards in the combined hand. Typically, the side game wager is resolved according to non-poker combinations, such as characteristics of the playing cards including card color, picture cards or the like.

17 Claims, 3 Drawing Sheets

DEALER AND PLAYER HAND COMBINATION SIDE WAGER

CROSS-REFERENCES TO RELATED APPLICATIONS

This is a continuation-in-part of U.S. patent application Ser. No. 10/262,901, filed Oct. 3, 2002, now U.S. Pat. No. 6,789,800, the entire content of which is hereby incorporated by reference in this application.

STATEMENT REGARDING FEDERALLY SPONSORED RESEARCH OR DEVELOPMENT (NOT APPLICABLE)

BACKGROUND OF THE INVENTION

The present invention relates to games of chance and, more particularly, to a side wager for casino-style games of chance where hands of cards are dealt to both one or more players and the dealer.

The casino game Let-It-Ride™, which is described in U.S. Pat. No. 5,288,081, features communal cards and player cards that are combined to make a hand. These communal cards, however, are not "dealer" cards per se, and in a heads-up game, those cards would belong specifically to one player. A Blackjack variation called 21+3, which is described in U.S. Pat. No. 6,012,719, features a Blackjack dealer face-up card combined with the player first two cards to define a combined hand. If a poker ranking of the combined hand exceeds a predetermined poker ranking, a payout is paid on the side wager. Subsequently, a conventional Blackjack game ensues.

It is desirable in a casino environment to offer readily understandable wagers having potential high payouts. Such high payouts generally serve as a draw to increase player participation and excitement. Of course, in order for such a game to be viable in a casino environment, the payouts must be established so that the casino maintains a reasonable advantage.

BRIEF SUMMARY OF THE INVENTION

The game according to the present invention is playable as a side wager preferably in conjunction with an existing game, such as Pai Gow Poker, wherein cards are dealt to the player and dealer to form respective player and dealer hands. Examples of suitable games for which the side wager game according to the present invention can be incorporated are described in U.S. patent application Ser. No. 09/845,332 [Triple Hand] and U.S. patent application Ser. No. 09/589,202 [ShoPoka], the contents of which are herein incorporated by reference. Generally, according to the present invention, a full player hand and a full dealer hand are combined to form a combined hand, wherein the side game wager is resolved according to the playing cards in the combined hand.

In an exemplary embodiment of the invention, a method of playing a side game is provided in combination with Pai Gow Poker where a dealer hand of playing cards is dealt to a dealer and a player hand of playing cards is dealt to a player. The method includes the steps of (a) receiving a side game wager from the player; (b) after dealing the dealer hand and the player hand, combining all playing cards from the dealer hand and player hand into a combined hand; and (c) resolving the side game wager based on the playing cards in the combined hand according to non-poker combinations, which exclude poker combinations including one pair, two pair, three-of-a-kind, straight, flush, full house, four-of-a-kind, straight flush, royal flush, and five-of-a-kind. In this context, step (c) may be practiced by resolving the side game wager according to characteristics of the playing cards in the combined hand, such as at least one of card color, picture cards, odd/even or high/low. Moreover, step (c) may be practiced by paying a payout if the combined hand contains at least a predetermined number of at least one of cards of a same color, picture cards, odd or even rank, or high cards or low cards. Generally, the payout is increased with an increased number of cards matching the card characteristics.

In one preferred embodiment, the dealer and player hands may each contain seven cards such that the combined hand contains fourteen cards. In this context, step (c) is practiced by resolving the side game wager according to characteristics of the fourteen playing cards in the combined hand.

In another embodiment, the method may include a step of paying an additional payout based on at least one specified card characteristic in at least one of the dealer hand only, the player hand only, the combined hand, or both the dealer hand and the player hand independently.

In another exemplary embodiment of the invention, a method of playing a side game is played in combination with Pai Gow Poker where at least one dealer hand of playing cards is dealt to a dealer, and at least one player hand of playing cards is dealt to a player. The method includes the steps of receiving a side game wager from the player; dealing the dealer hand and the player hand according to Pai Gow Poker rules; completing the game of Pai Gow Poker according to the Pai Gow Poker rules; combining all playing cards from the dealer hand and the player hand into a combined hand; and resolving the side game wager according to the playing cards in the combined hand according to non-poker combinations, which exclude poker combinations including one pair, two pair, three-of-a-kind, straight, flush, full house, four-of-a-kind, straight flush, royal flush, and five-of-a-kind.

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

In the following detailed description, a method and apparatus according to the present invention will be described in conjunction with its application to a casino environment, thus incorporating wagers, payouts, etc. Those of ordinary skill in the art will readily comprehend alternative applications of the present invention outside a casino environment, and the invention is not meant to be limited to the described application. For example, the game may be embodied in a video game that is played for entertainment purposes against a computer or the like. Alternatively, players may play the game without wagers in a head-to-head format with one player acting as a dealer, with the players simply keeping track of wins and losses.

Figure 1:
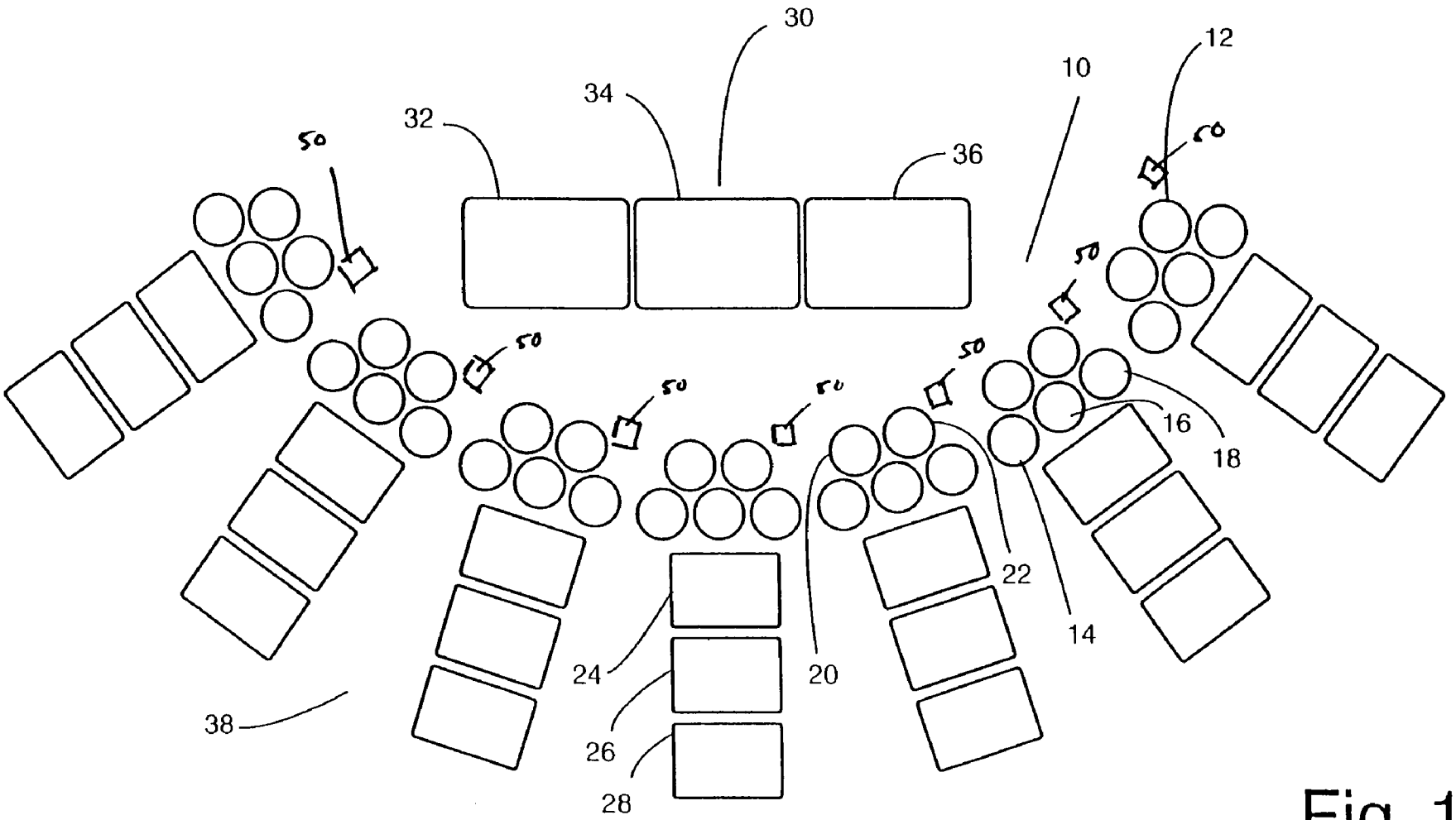
FIG. 1 is an exemplary table layout incorporating the side wager option according to the present invention.

FIG. 1 is a modified table layout from Triple Hand poker, which is the subject of the above-noted U.S. patent application Ser. No. 09/845,332, filed May 1, 2001. As noted above, the side wager game according to the present invention is suited for any player versus dealer game where the dealer and each player are dealt respective hands of cards. A head-to-head format may also be used where one player acts as the dealer. The reference numerals in FIG. 1 are described in the subject co-pending application.

The layout is modified to incorporate a side wager area 50 for each player. The side wager game can be played before or after the underlying game of chance. After dealing hands of cards to the dealer and each respective player, all playing cards from the dealer hand and player hand are combined into a combined hand. The side game wager is resolved according to the playing cards in the combined hand.

Preferably, the side game wager is resolved using non-poker combinations, such as based on the characteristics of the playing cards in the combined hand. For example, the card characteristics may include at least one of card color or suit, picture cards, odd/even cards, high/low cards, etc. For example, in the underlying game illustrated in FIG. 1, each player and the dealer are dealt five cards. The combined hands will thus contain ten cards, being the dealer's five cards plus each of the players' five cards, respectively. Preferably, the side wager is resolved by paying a payout if the combined hand contains at least a predetermined number of cards having the same characteristics. In a game where five card hands are dealt to each player and the dealer, a payout is typically paid if the combined hand contains, for example, at least seven cards of a same color or at least four picture cards. The payout is increased with an increased number of cards matching the card characteristics, for example as set forth below, where payoffs A–G can increase from a minimum of 1—1 to a much higher amount.

| | | | | | | | |
|---|---|---|---|---|---|---|---|
| Cards of Same Color | | 7 | 8 | 9 | 10 | | |
| Payoff | | A | B | C | D | | |
| Picture Cards | 4 | 5 | 6 | 7 | 8 | 9 | 10 |
| Payoff | A | B | C | D | E | F | G |

Such a high payoff, for example with ten picture cards in the combined hand has a much higher payoff potential than even a Royal Flush while maintaining viability for casino play.

In an additional application, the side game of the present invention may be suitable for play with conventional Pai Gow Poker, where each player and the dealer is dealt seven cards to form one hand of five cards and one hand of two cards. The side game wager may be resolved based on characteristics of the fourteen (14) cards combined between the dealer and each player.

Figure 3:
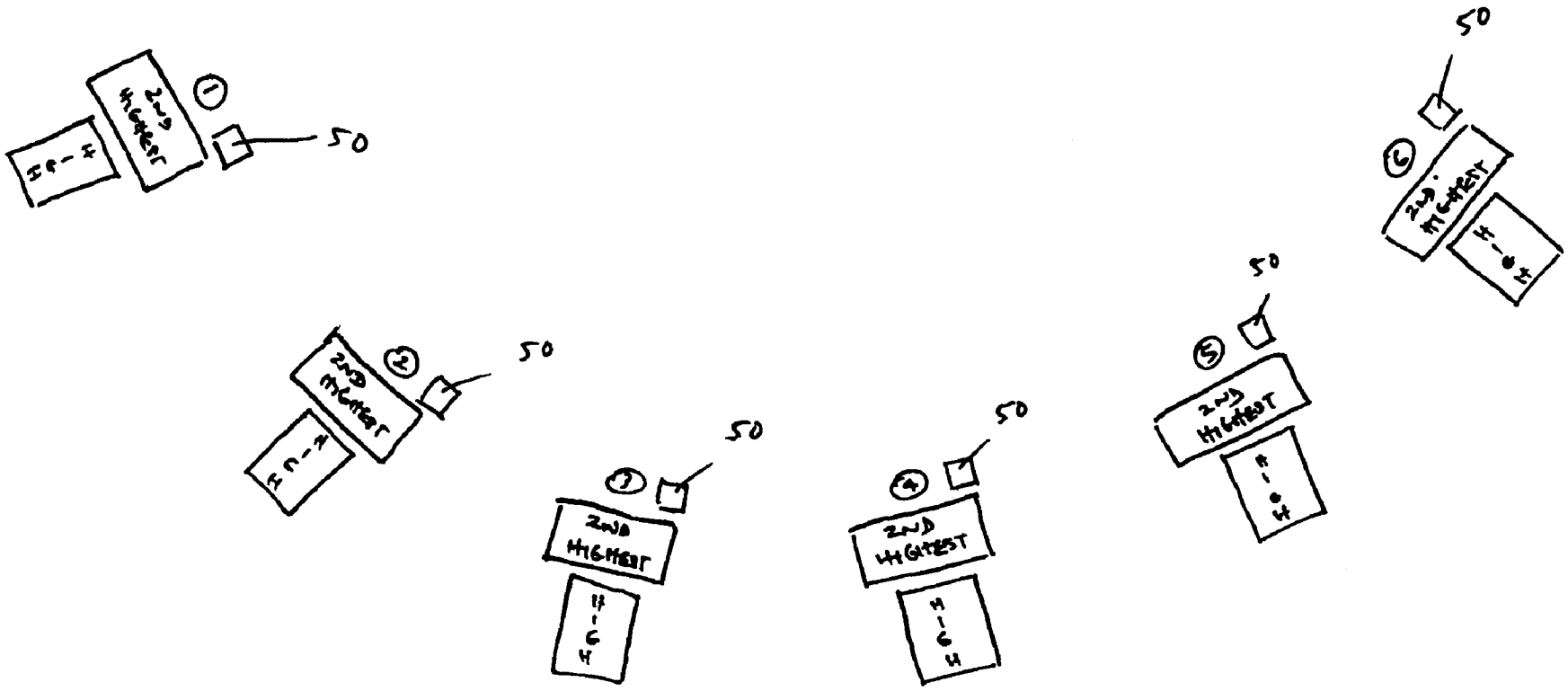
FIG. 3 is an exemplary table layout incorporating the side wager in a Pai Gow Poker game.

FIG. 3 is a modified table layout of a conventional Pai Gow Poker casino game. The layout is modified to include a side wager area 50 for each player. The rules and game play of Pai Gow Poker are well-known and will not be described in detail. A standard deck in Pai Gow Poker consists of fifty-three (53) cards, including fifty-two (52) standard cards and one (1) Joker. During play, the Joker can be used as a wild card to complete a straight or a flush or alternatively as an Ace.

As in the embodiment described above, a player can participate in the side wager by placing a wager in the side wager area 50. After cards are dealt to the player(s) and the dealer, where each hand in Pai Gow Poker includes seven (7) cards, thus forming a combined player-dealer hand of fourteen (14) cards, the side game wagers can be resolved according to the following schedule:

| | |
|---|---|
| Joker (player hand) | 5 to 1 |
| Player 7 cards of same color | 10 to 1 |
| Player 6 cards of same color and Joker | 20 to 1 |
| Player 7 cards of same color and dealer 7 cards of other color | 100 to 1 |
| Player and dealer 14 cards same color | 250 to 1 |

Of course, other payoff combinations of combined player-dealer hands may be viable, and the invention is not necessarily meant to be limited to the exemplary schedule. For purposes of the combined hand, the Joker may be used as a wild card to match any non-poker characteristic. In the exemplary schedule above, a Joker could thus be used to match card color.

An alternative or still additional operating mode of the invention incorporates an additional variable pay scale for specific independent and/or combined hands. The player may be required to place a separate wager to participate in the additional operating mode, or the feature may be added as part of the side game (according to the present invention) or even as part of the underlying game (Let-it-Ride, 21+3, etc.). For example, the player may receive a payout, regardless of the makeup of the combined hand, if the dealer hand contains cards sharing one or more specified card characteristics, such as card color. Similarly, the player may receive a payout if the player hand contains cards sharing one or more specified card characteristics. The additional payout may be paid only if both the dealer and player hands respectively contain cards sharing card characteristics although not necessarily the same (e.g., dealer hand all RED, player hand all BLACK); although yet another provision incorporates a higher payout when all dealer and player cards share the one or more specified card characteristics. Certainly, many other variations are possible, and the invention is not necessarily meant to be limited to a particular example described above.

As would be apparent to those skilled in the relevant art, the invention can be embodied in a wide variety and forms of media such as, but not limited to, single player slot video machines, multi-player slot video machines, electronic games and devices, lottery terminals, scratch-card formats, software, as well as in-flight, home and Internet entertainment. In addition, the invention can be readily implemented as a computer program product (e.g., floppy disk, compact disk, etc.) comprising a computer readable medium having control logic recorded therein to implement the features of the invention as described in relation to the other preferred embodiments. Control logic can be loaded into the memory of a computer and executed by a central processing unit (CPU) to perform the operations described herein.

Figure 2:
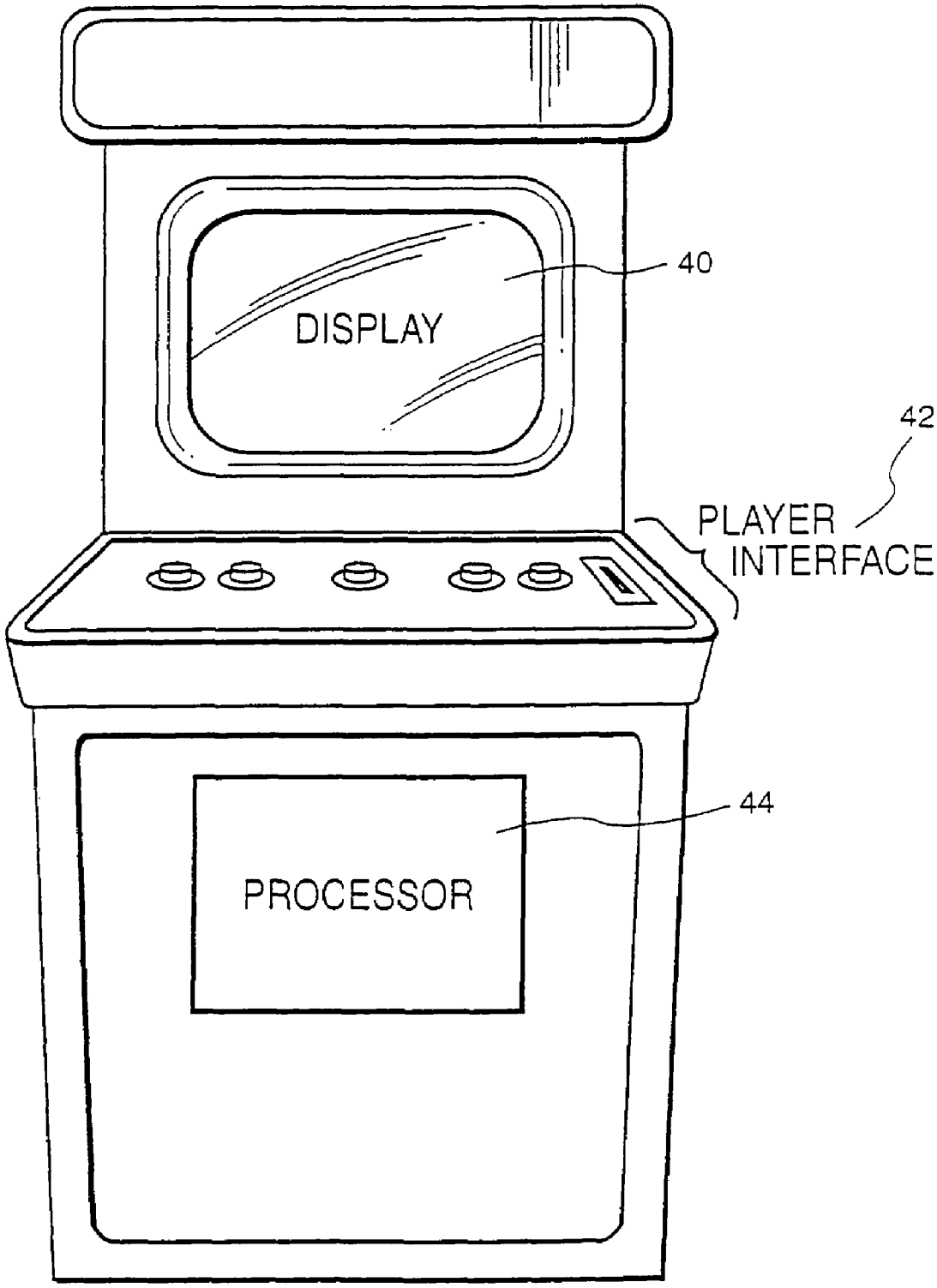
FIG. 2 is a schematic diagram illustrating the structure effecting game play according to the apparatus of the present invention.

In this context, referring to FIG. 2, a schematic diagram is illustrated showing the components of an apparatus configured for playing the game according to the invention. The apparatus includes a display 40, a player interface 42, and circuitry 44 for effecting game play and including structure for receiving wagers, dealing hands and resolving wagers according to the game rules. That is, a processing circuit 44 is programmed to effect game play according to the rules of the game, enabling players to play the underlying game as well as form the combined hand of the side wager game according to the invention. The system resolves the side wager based on a number of cards having the preset characteristics in the combined hand.

The side wager game according to the present invention is easily implemented into many existing games and can bring added excitement and player participation. Casino implementation including dealer training and the like is easily performed, and players can easily understand the concept of the game and what is necessary to win. In addition, the chance for an exceedingly high payout is a considerable player draw.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A method of playing a side game in combination with Pai Gow Poker where a dealer hand of playing cards is dealt to a dealer and a player hand of playing cards is dealt to a player, the method comprising:

(a) receiving a side game wager from the player;

(b) after dealing the dealer hand and the player hand, combining all playing cards from the dealer hand and player hand into a combined hand; and (c) resolving the side game wager based on the playing cards in the combined hand according to non-poker combinations, which exclude poker combinations including one pair, two pair, three-of-a-kind, straight, flush, full house, four-of-a-kind, straight flush, royal flush, and five-of-a-kind.

2. A method according to claim 1, wherein step (c) is practiced by paying a payout for a combined hand having a winning non-poker combination, the winning non-poker combinations including:

Joker (player hand)

Player 7 cards of same color

Player 6 cards of same color and Joker

Player 7 cards of same color and dealer 7 cards of other color

Player and dealer 14 cards same color.

3. A method according to claim 2, wherein step (c) is further practiced by paying the payout according to the following schedule:

| | |
|---|---|
| Joker (player hand) | 5 to 1 |
| Player 7 cards of same color | 10 to 1 |
| Player 6 cards of same color and Joker | 20 to 1 |
| Player 7 cards of same color and dealer 7 cards of other color | 100 to 1 |
| Player and dealer 14 cards same color | 250 to 1. |

4. A method according to claim 1, wherein step (c) is practiced by resolving the side game wager according to characteristics of the playing cards in the combined hand.

5. A method according to claim 4, wherein the card characteristics comprise at least one of card color, picture cards, odd/even or high/low.

6. A method according to claim 5, wherein step (c) is practiced by paying a payout if the combined hand contains at least a predetermined number of at least one of cards of a same color, picture cards, odd or even rank, or high cards or low cards.

7. A method according to claim 6, wherein the payout is increased with an increased number of cards matching the card characteristics.

8. A method according to claim 1, wherein the dealer hand contains seven cards and the player hand contains seven cards such that the combined hand contains fourteen cards, and wherein step (c) is practiced by resolving the side game wager according to characteristics of the fourteen playing cards in the combined hand.

9. A method according to claim 1, further comprising paying an additional payout based on at least one specified card characteristic in at least one of the dealer hand only, the player hand only, the combined hand, or both the dealer hand and the player hand independently.

10. A method of playing a side game in combination with Pai Gow Poker where a dealer hand of playing cards is dealt to a dealer, and a player hand of playing cards is dealt to a player, the method comprising:

(a) receiving a side game wager from the player;

(b) dealing at least one dealer hand and at least one player hand according to Pai Gow Poker rules;

(c) completing the game of Pai Gow Poker according to the Pai Gow Poker rules;

(d) combining all playing cards from the dealer hand and the player hand into a combined hand; and (e) resolving the side game wager based on the playing cards in the combined hand according to non-poker combinations, which exclude poker combinations including one pair, two pair, three-of-a-kind, straight, flush, full house, four-of-a-kind, straight flush, royal flush, and five-of-a-kind.

11. A method according to claim 10, wherein steps (d) and (e) are practiced prior to step (c).

12. A method according to claim 10, wherein the dealer hand contains seven cards and the player hand contains seven cards such that the combined hand contains fourteen cards, and wherein step (e) is practiced by resolving the side game wager according to characteristics of the fourteen playing cards in the combined hand.

13. A method according to claim 10, wherein step (e) is practiced by resolving the side game wager according to characteristics of the playing cards in the combined hand.

14. A method according to claim 13, wherein the card characteristics comprise at least one of card color, picture cards, odd/even or high/low.

15. A method according to claim 10, further comprising paying an additional payout based on at least one specified card characteristic in at least one of the dealer hand only, the player hand only, the combined hand, or both the dealer hand and the player hand independently.

16. A method according to claim 10, wherein step (c) is practiced by paying a payout for a combined hand having a winning non-poker combination, the winning non-poker combinations including:

Joker (player hand)

Player 7 cards of same color

Player 6 cards of same color and Joker

Player 7 cards of same color and dealer 7 cards of other color

Player and dealer 14 cards same color.

17. A method according to claim 16, wherein step (c) is further practiced by paying the payout according to the following schedule:

| | |
|---|---|
| Joker (player hand) | 5 to 1 |
| Player 7 cards of same color | 10 to 1 |
| Player 6 cards of same color and Joker | 20 to 1 |

-continued

| | |
|---|---|
| Player 7 cards of same color and dealer 7 cards of other color | 100 to 1 |
| Player and dealer 14 cards same color | 250 to 1. |

* * * * *